US010919730B2

(12) United States Patent
Lotfi et al.

(10) Patent No.: US 10,919,730 B2
(45) Date of Patent: Feb. 16, 2021

(54) MANAGEMENT OF MUTIPLE COIL BRAKE FOR ELEVATOR SYSTEM

(71) Applicant: Otis Elevator Company, Farmington, CT (US)

(72) Inventors: Amir Lotfi, South Windsor, CT (US); Daniel M. Bohn, Bristol, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 295 days.

(21) Appl. No.: 15/074,402

(22) Filed: Mar. 18, 2016

(65) Prior Publication Data

US 2017/0267486 A1 Sep. 21, 2017

(51) Int. Cl.
*B66B 1/32* (2006.01)
*B66B 1/34* (2006.01)
*B66B 9/00* (2006.01)

(52) U.S. Cl.
CPC ..... *B66B 1/32* (2013.01); *B66B 1/3407* (2013.01); *B66B 9/00* (2013.01)

(58) Field of Classification Search
USPC ..... 187/247
See application file for complete search history.

(56) References Cited

U.S. PATENT DOCUMENTS 4,042,069 A * 8/1977 Ohira ..... H02P 5/747 187/296
4,478,315 A 10/1984 Nomura
4,902,954 A 2/1990 Oshima et al.
4,982,815 A 1/1991 Arabori et al.
5,002,158 A 3/1991 Ericson et al.
5,153,389 A 10/1992 Nomura
5,199,532 A 4/1993 Suganuma et al.
5,201,821 A 4/1993 Ericson et al.
5,244,060 A * 9/1993 Tanaka ..... B66B 1/32 187/261
5,699,883 A 12/1997 Albrecht
6,269,910 B1 * 8/2001 Fargo ..... B66B 3/00 187/287
7,730,998 B2 6/2010 Takahashi et al.
7,740,110 B2 6/2010 Kattainen et al.
7,891,466 B2 2/2011 Okamoto et al.
7,958,977 B2 6/2011 Klingler et al.
(Continued)

FOREIGN PATENT DOCUMENTS

CN 201280406 Y 7/2009
CN 102190222 A 9/2011
(Continued)

OTHER PUBLICATIONS

International Search Report and Written Opinion for application PCT/S2017/022098, dated Jun. 12, 2017, 12pgs.

*Primary Examiner* — Christopher Uhlir
(74) *Attorney, Agent, or Firm* — Cantor Colburn LLP

(57) ABSTRACT

An elevator system includes an elevator car; a machine to impart motion to the elevator car; a brake to stop rotation of the machine, the brake comprising a first coil and a second coil, wherein removing power from the first coil and the second coil applies the brake to the machine; and a controller in communication with the brake, the controller configured to connect the first coil and the second coil in one of a first electrical configuration and a second electrical configuration.

9 Claims, 7 Drawing Sheets

(56) References Cited

U.S. PATENT DOCUMENTS

| | | | | |
|---|---|---|---|---|
| 8,136,637 | B2 | 3/2012 | Coquerelle et al. | |
| 8,167,094 | B2 * | 5/2012 | Ueda | B66B 1/32 187/288 |
| 8,376,090 | B2 * | 2/2013 | Kostka | B66B 5/021 187/281 |
| 8,550,219 | B2 | 10/2013 | Eberle et al. | |
| 8,820,484 | B2 * | 9/2014 | Rui | B66B 1/32 187/288 |
| 9,046,142 | B2 | 6/2015 | Kattainen | |
| 2008/0074823 | A1 * | 3/2008 | Yang | H01H 47/043 361/155 |
| 2013/0313052 | A1 | 11/2013 | Della Porta | |

FOREIGN PATENT DOCUMENTS

| | | | |
|---|---|---|---|
| CN | 202001532 | U | 10/2011 |
| CN | 202152814 | U | 2/2012 |
| CN | 103112794 | A | 5/2013 |
| CN | 203055591 | U | 7/2013 |
| CN | 203373067 | U | 1/2014 |
| CN | 203794538 | U | 8/2014 |
| CN | 104340787 | A | 2/2015 |
| DE | 202005009053 | U1 | 8/2005 |
| EP | 0947725 | A2 | 10/1999 |
| EP | 2201260 | A1 | 6/2010 |
| EP | 2331839 | A1 | 6/2011 |
| EP | 2744738 | B1 | 6/2014 |
| JP | 2008056428 | A | 3/2008 |

* cited by examiner

MANAGEMENT OF MUTIPLE COIL BRAKE FOR ELEVATOR SYSTEM

BACKGROUND

The subject matter disclosed herein relates generally to the field of elevator systems, and more particularly to controlling an electrical configuration of coils in an elevator brake to control a braking time.

In existing elevator systems, a machine drives a traction sheave to impart motion to an elevator car. A brake is used to stop rotation of the traction sheave and halt motion of the elevator car. Typically, the brake includes a single electrical coil which drops immediately in an emergency stop. Due to the high instantaneous brake torque, the car may stop quickly, causing discomfort to passengers.

BRIEF SUMMARY

According to one embodiment, an elevator system includes an elevator car; a machine to impart motion to the elevator car; a brake to stop rotation of the machine, the brake comprising a first coil and a second coil, wherein removing power from the first coil and the second coil applies the brake to the machine; and a controller in communication with the brake, the controller configured to connect the first coil and the second coil in one of a first electrical configuration and a second electrical configuration.

In addition to one or more of the features described above, or as an alternative, further embodiments may include wherein the first electrical configuration comprises the first coil and second coil in electrical parallel.

In addition to one or more of the features described above, or as an alternative, further embodiments may include wherein the second electrical configuration comprises the first coil and second coil in electrical series.

In addition to one or more of the features described above, or as an alternative, further embodiments may include a brake management switch connected to the first coil and the second coil, the controller controlling the brake management switch to connect the first coil and the second coil in one of the first electrical configuration and the second electrical configuration.

In addition to one or more of the features described above, or as an alternative, further embodiments may include wherein the brake management switch comprises a relay.

In addition to one or more of the features described above, or as an alternative, further embodiments may include wherein the controller is configured to determine an operating mode of the elevator system, the controller configured to connect the first coil and the second coil in one of the first electrical configuration and the second electrical configuration in response to the operating mode.

In addition to one or more of the features described above, or as an alternative, further embodiments may include wherein the controller is configured to connect the first coil and the second coil in electrical parallel in response to determining that the operating mode of the elevator system comprises a motoring mode.

In addition to one or more of the features described above, or as an alternative, further embodiments may include wherein the controller is configured to connect the first coil and the second coil in electrical series in response to determining that the operating mode of the elevator system comprises a regenerative mode.

Accordingly to another embodiment, a method of controlling an elevator brake having a first coil and a second coil includes determining an operating mode of the elevator system; and connecting the first coil and the second coil in one of a first electrical configuration and a second electrical configuration in response to the operating mode.

In addition to one or more of the features described above, or as an alternative, further embodiments may include wherein the connecting comprises connecting the first coil and the second coil in electrical parallel in response to determining that the operating mode of the elevator system comprises a motoring mode.

In addition to one or more of the features described above, or as an alternative, further embodiments may include wherein the connecting comprises connecting the first coil and the second coil in electrical series in response to determining that the operating mode of the elevator system comprises a regenerative mode.

Technical effects of embodiments of the present disclosure include the ability to control the braking time of an elevator brake by altering an electrical configuration of coils in the brake.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The foregoing and other features, and advantages of the disclosure are apparent from the following detailed description taken in conjunction with the accompanying drawings in which like elements are numbered alike in the several FIGURES.

DETAILED DESCRIPTION

Figure 1:
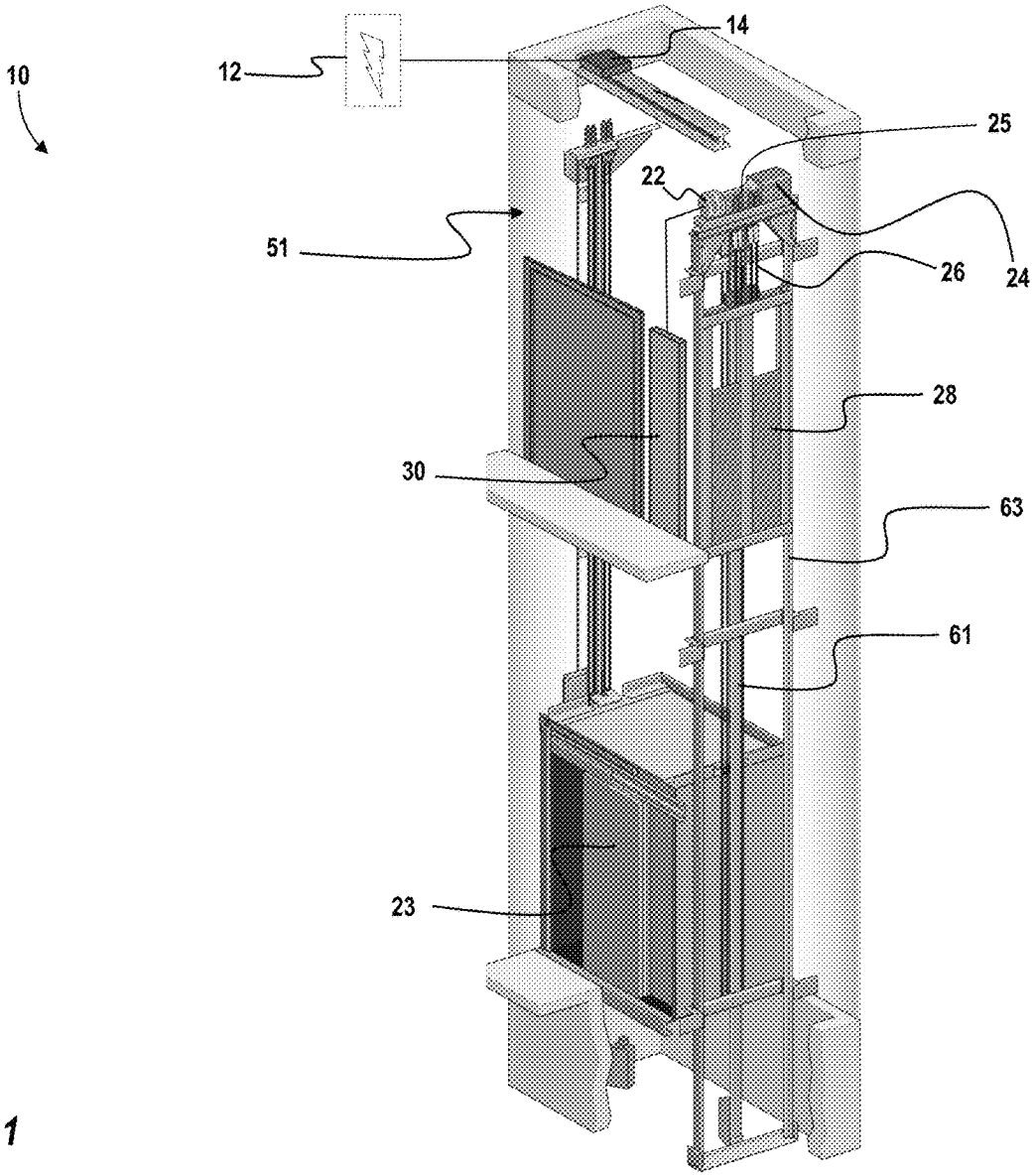
FIG. 1 depicts an elevator system in an exemplary embodiment.
Figure 2:
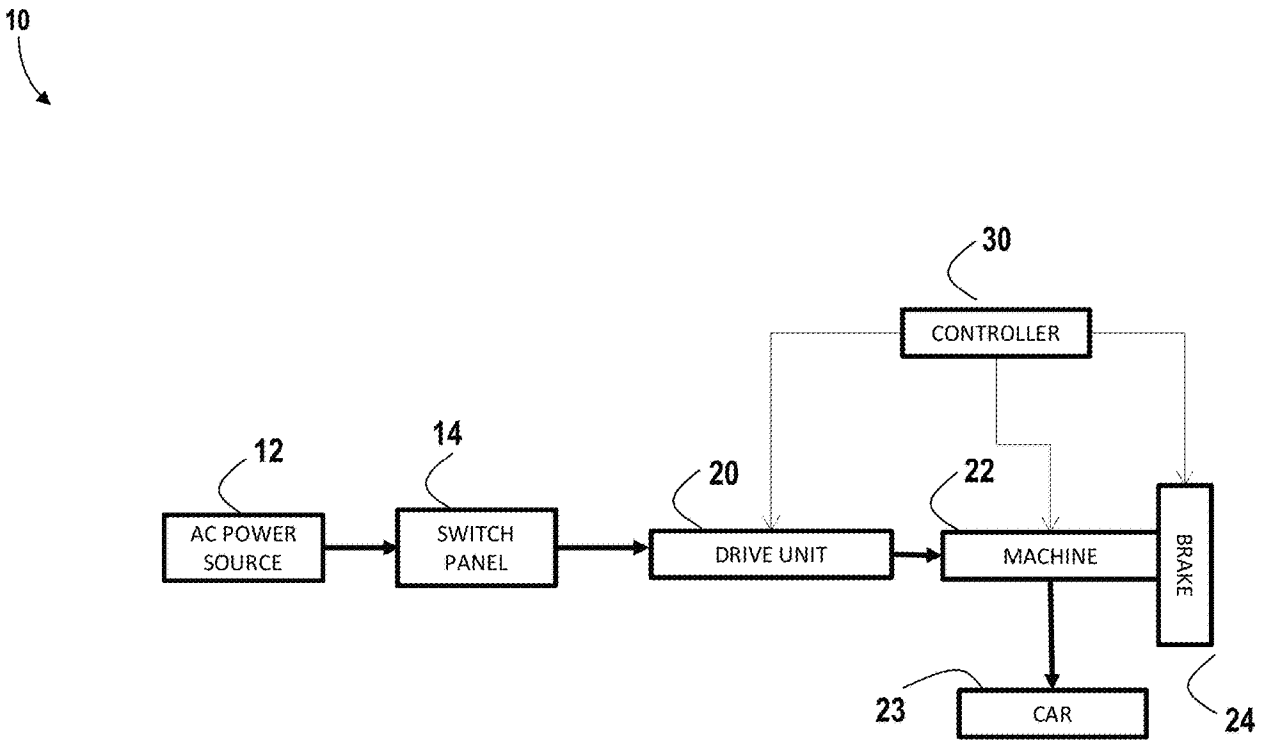
FIG. 2 is a block diagram of components of an elevator system in an exemplary embodiment.

FIG. 1 depicts an elevator system 10, in accordance with an embodiment of the disclosure. FIG. 2 is a block diagram of components of elevator system 10 in an exemplary embodiment. The elevator system 10 includes an elevator car 23 configured to move vertically upward and downward within a hoistway 51 along a plurality of car guide rails 61. The elevator system 10 also includes a counterweight 28 operably connected to the elevator car 23 via a pulley system 26. The counterweight 28 is configured to move vertically upward and downward within the hoistway 51. The counterweight 28 moves in a direction generally opposite the movement of the elevator car 23, as is known in conventional elevator systems. Movement of the counterweight 28 is guided by counterweight guide rails 63 mounted within the hoistway 51.

The elevator system 10 also includes an alternating current (AC) power source 12, such as an electrical main line grid (e.g., 230 volt, single phase). The AC power is provided from the AC power source 12 to a switch panel 14, which may include circuit breakers, meters, inverter/converter, etc. From the switch panel 14, power is provided to a drive unit 20 (FIG. 2), which produces drive signals for machine 22. The drive unit 20 drives a machine 22 to impart motion to the elevator car 23 via a traction sheave 25 of the machine. The drive signals may be multiphase (e.g., three-phase) drive signals for a three-phase motor in the machine 22. A brake 24 may be integrated with the machine 22 and be activated to stop the machine 22 and elevator car 23.

The drive unit 20 generates drive signals to for driving machine 22 in motoring mode. Motoring mode may occur when an empty elevator car is traveling downwards or a loaded elevator car is traveling upwards. Motoring mode refers to situations where the machine 22 is drawing current from the drive unit 20. The system may also operate in a regenerative mode where power from machine 22 is fed back to the drive unit 20 and the AC power source 12. Regenerative mode may occur when an empty elevator car is traveling upwards or when a loaded elevator car is traveling downwards. Regenerative mode refers to situations where the drive unit 20 receives current from the machine 22 (which acts as a generator) and supplies current back to the AC power source 12. A near balance mode occurs when the weight of the elevator car 23 is about balanced with the weight of the counterweight 28. Near balance mode operates similarly to motoring mode because the machine 22 is drawing current from the drive unit 20 to move the elevator car 23.

The controller 30 is responsible for controlling the operation of the elevator system 10. The controller 30 may include a processor and an associated memory. The processor may be but is not limited to a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be but is not limited to a random access memory (RAM), read only memory (ROM), or other electronic, optical, magnetic or any other computer readable medium.

Figure 3:
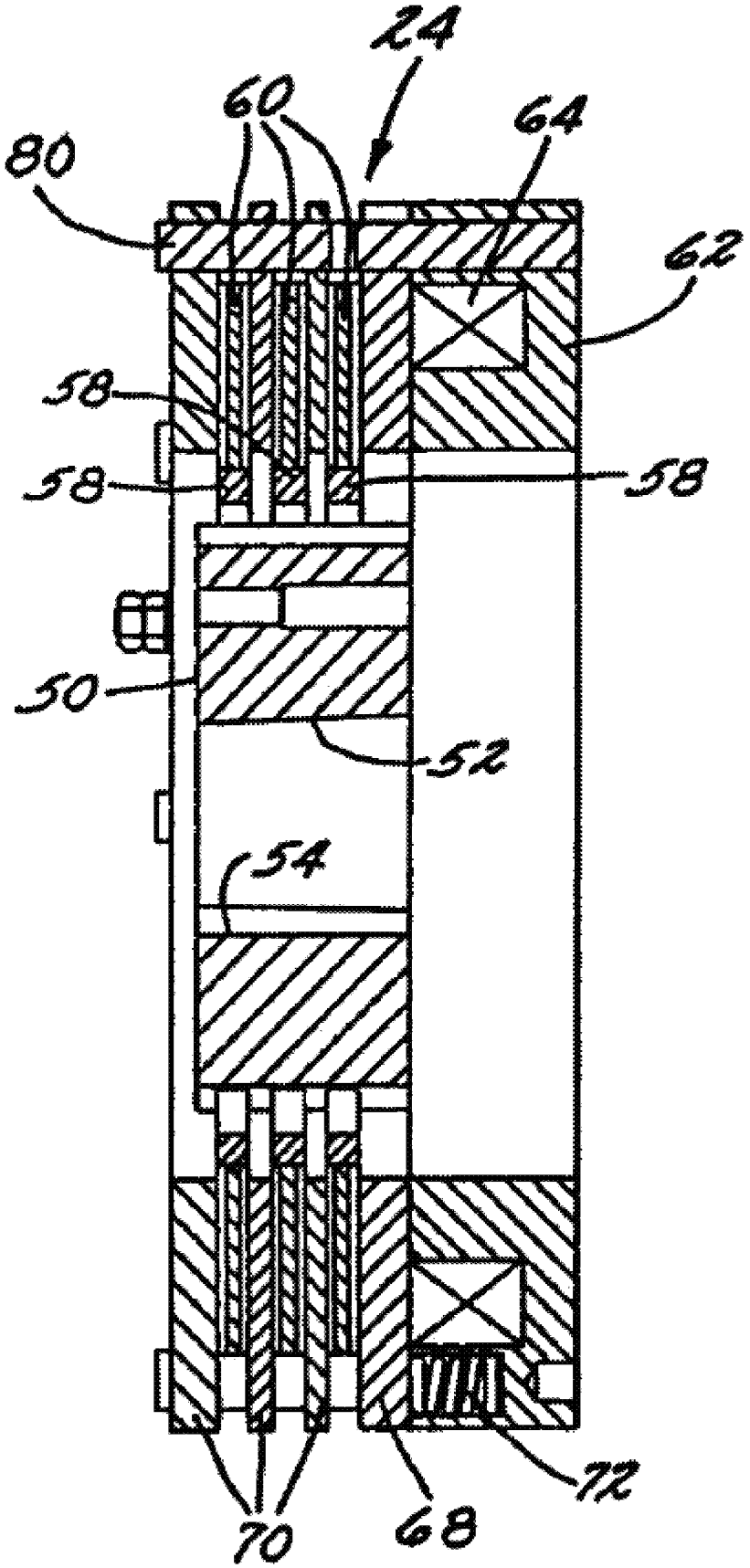
FIG. 3 depicts a portion of a brake in an exemplary embodiment.

FIG. 3 depicts a portion of a brake 24 in an exemplary embodiment. The brake 24 includes a central hub 50 which has a through tapered passage 52 with a key slot 54. The outer circumferential surface of the hub 50 is formed with splines so as to be fitted with a plurality of internally splined friction discs 58 of a suitable number, depending on the amount of braking torque which is required in each application. Each of the discs 58 carries an annular radially outwardly extending friction pad 60. It will be appreciated from the above, that the hub 50, discs 58 and pads 60 all rotate with the traction sheave 25. The brake 24 also includes a magnet assembly 62 having coils 64, and which are mounted on a base plate. An armature plate 68 is disposed adjacent to the magnet assembly 62, followed by a series of annular brake plates 70. It will be noted that the friction discs 60 and brake plates 70 are interleaved. The armature plate 68 is biased away from the magnet assembly 62 by a plurality of coil springs 72. A plurality of guide dowels 80 dispersed circumferentially about the brake assembly 24 extend through the magnet assembly 62, and the armature plate 68 and brake plates 70 to guide axial movement of these components relative to each other when the brake is set and released. It will be appreciated from the above that the discs 60 rotate with the traction sheave 25, while the plates 70 remain relatively stationary.

During normal operation of the elevator, the coils 64 are energized, and the armature plate 68 is magnetically held against the magnet assembly 62 causing the actuating springs 72 to be compressed. The brake 24 is thus in a "release" mode, and the friction discs 60 will be free to rotate, uninhibited by the plates 70. In the event of a need to stop the car 23, such as overspeed in either direction, or door-open movement of the cab away from a landing, power to the coils 64 will be switched off, and the coils 64 will deenergize. The actuating springs 72 will then move the armature plate 68 away from the magnet assembly 62 and toward the annular brake plates 70. The force of the springs 72 is such that the plates 70 will clamp the discs 60 against further movement. Movement of the traction sheave 25 will thus be interrupted and the car 23 will stop its movement in the hoistway 51. The brake 24 can be released by restoring power to the coil 64.

The brake 24 includes multiple coils 64. Embodiments connect the coils 64 in a first electrical configuration or a second electrical configuration in order to control the braking time. Different braking times may be desired depending on the mode of operation of the elevator system 10. For example, in a motoring mode the elevator system 10 may desire to employ a slower braking time. In regenerative mode, the elevator system 10 may desire to employ a faster braking time.

Figure 4:
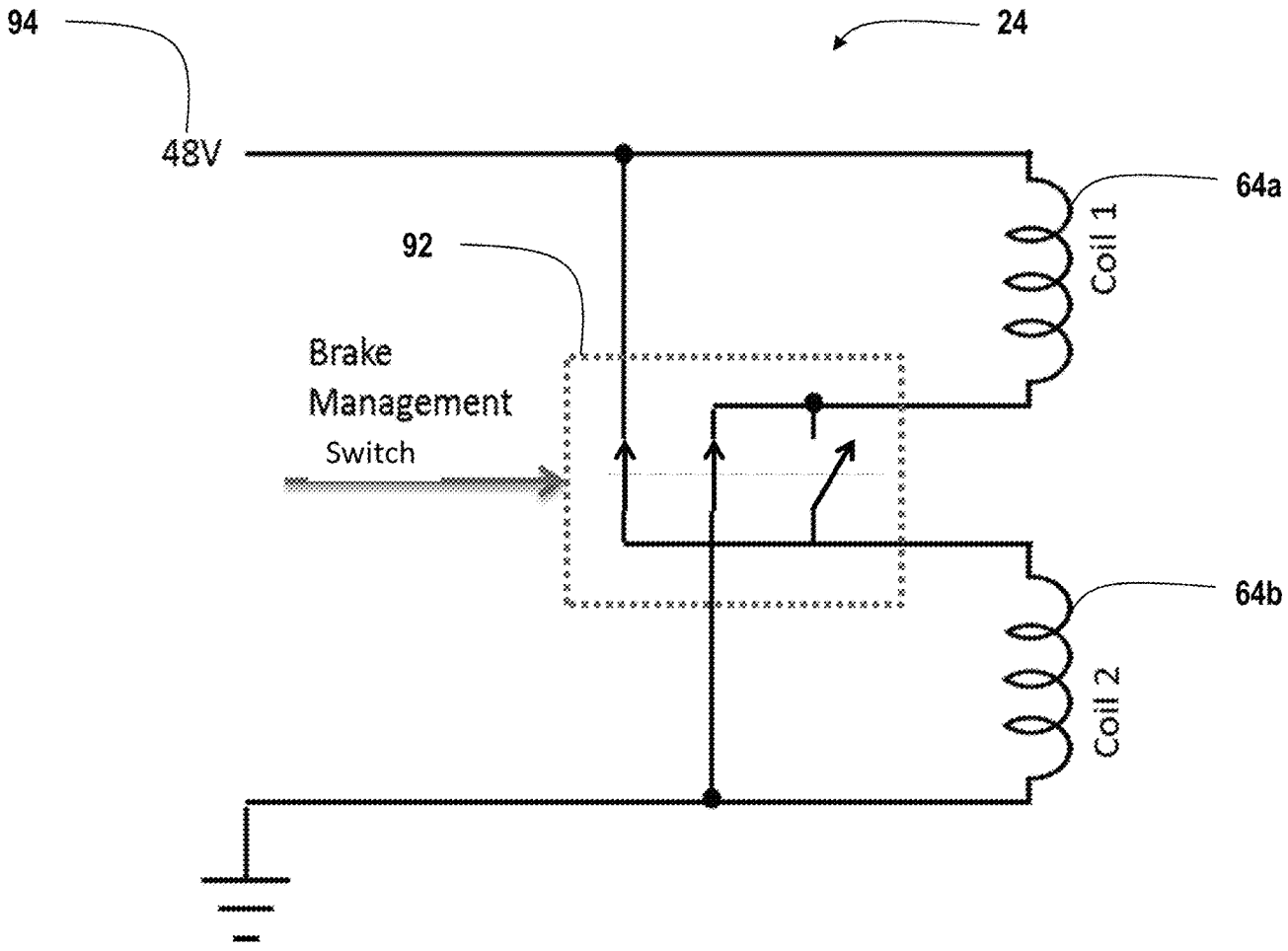
FIG. 4 depicts coils of the elevator brake in a first electrical configuration in an exemplary embodiment.

FIG. 4 depicts coils 64*a* and 64*b* of the elevator brake in a first electrical configuration in an exemplary embodiment. The brake 24 includes a brake management switch 92 that connects the coils 64*a* or 64*b* in a first or second electrical configuration with respect to a voltage source 94 (e.g., 48 volts). The brake management switch 92 may be a relay having multiple poles, a series of electrically controlled switches (e.g., transistors), etc. With the brake management switch 92 in the first electrical configuration shown in FIG. 4, coils 64*a* and 64*b* are in electrical parallel. This places the full voltage of voltage source 94 across each coil 64*a* and 64*b*. In the event the elevator car 23 needs to stop, controller 30 interrupts voltage source 94 so that no power is connected to coils 64*a* and 64*b*. It takes time for the magnetic field of the coils 64*a* and 64*b* to dissipate to a point where the spring 72 overcomes the magnetic field of coils 64*a* and 64*b*. Since both coils 64*a* and 64*b* receive the full voltage from voltage source 94, then amount of time for the brake 24 to be applied is longer than in the second electrical configuration of FIG. 5.

Figure 5:
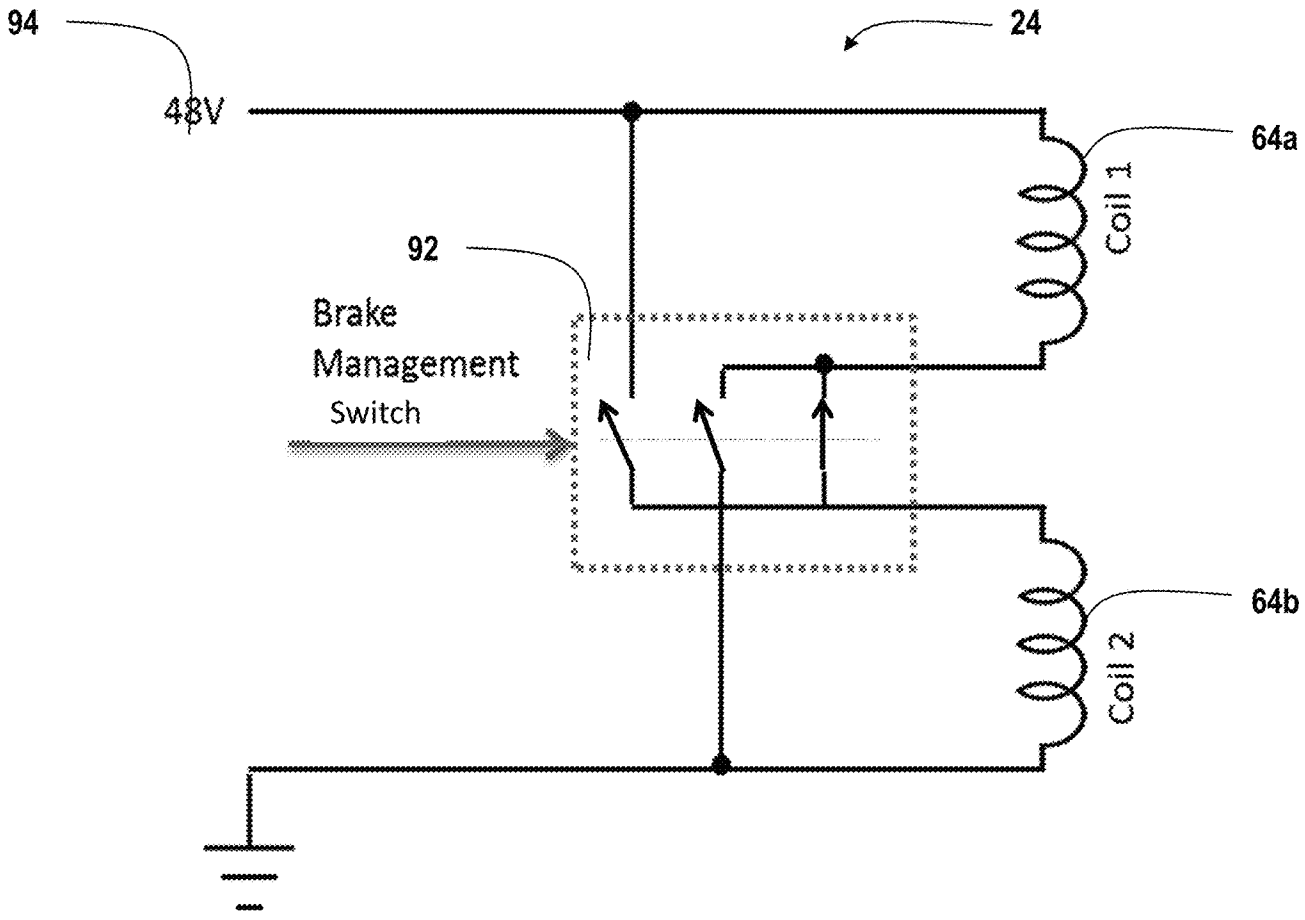
FIG. 5 depicts coils of the elevator brake in a second electrical configuration in an exemplary embodiment.

FIG. 5 depicts coils 64*a* and 64*b* of the elevator brake in a second electrical configuration in an exemplary embodiment. With the brake management switch 92 in the second electrical configuration shown in FIG. 5, coils 64*a* and 64*b* are in electrical series. This places the half the voltage of voltage source 94 across each coil 64*a* and 64*b*. In the event the elevator car 23 needs to stop, controller 30 interrupts voltage source 94 so that no power is connected to coils 64*a* and 64*b*. Since both coils 64*a* and 64*b* receive half the voltage from voltage source 94, then amount of time for the brake to be applied is shorter than in the first electrical configuration of FIG. 5.

Figure 6:
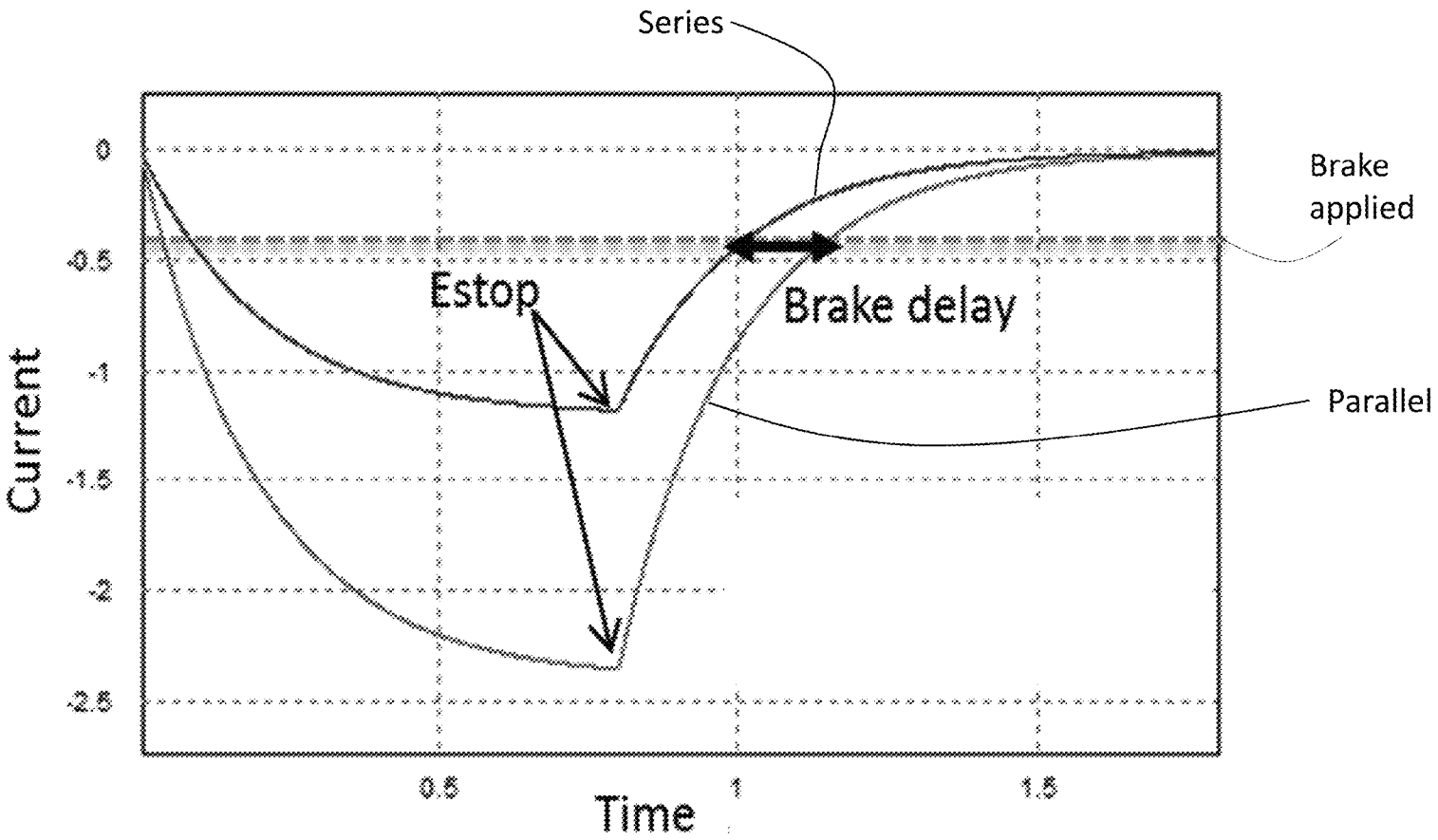
FIG. 6 depicts brake coil current versus time for two brake coil configurations in an exemplary embodiment.

FIG. 6 depicts brake coil current versus time for two brake coil configurations in an exemplary embodiment. FIG. 6 depicts the occurrence of an emergency stop situation and the time for the brake coil current to dissipate to a level where the brake 24 stops traction sheave 25 (e.g., about −0.4 amps). As shown in FIG. 6, when the coils 64*a* and 64*b* are connected in series, the time for the coil current to decay to a brake applied limit is shorter than the time for the coil current to decay to the brake applied limit when the coils 64*a* and 64*b* are connected in parallel. This difference in time is shown as a brake delay in FIG. 6.

Figure 7:
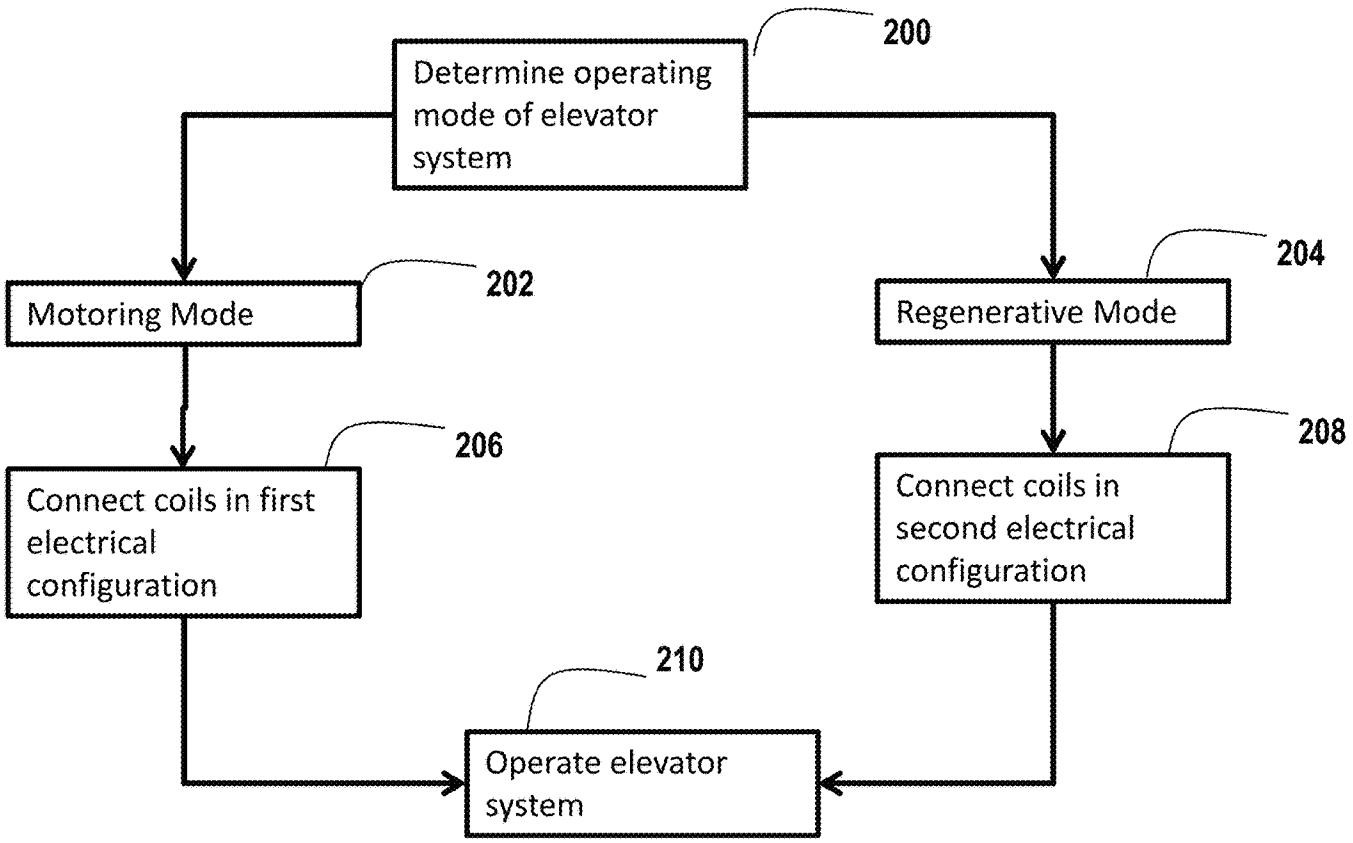
FIG. 7 depicts a flowchart of a process for controlling an elevator brake in an exemplary embodiment.

FIG. 7 depicts a flowchart of a process for controlling an elevator brake in an exemplary embodiment. The process of FIG. 7 may be implemented by controller 30 at the start or the initial part of an elevator run. At 200, controller 30 determines the operating mode of the elevator system. The operating mode may be detected as motoring mode (202) or regenerative mode (204). The controller 30 may detect the operational mode based on direction of travel of the car 23 and the car load. The car load may be detected by in car load sensors, entrance/exit sensors, car-counterweight imbalance, etc. If the operational mode is detected as motoring mode, flow proceeds to 206 where the controller 30 controls the brake management switch 92 to place the coils 64*a* and 64*b* in the first electrical configuration of FIG. 4, i.e., the coils 64*a* and 64*b* in electrical parallel with the voltage source 94. If the operational mode is detected as regenerative mode, flow proceeds to 208 where the controller 30 controls the brake management switch 92 to place the coils 64*a* and 64*b* in the second electrical configuration of FIG. 5, i.e., the coils 64*a* and 64*b* in electrical series with the voltage source 94. At 210, the elevator system is then operated in normal.

Embodiments provide effective brake sequencing by controlling the voltage on each coil through circuit topology changes (e.g., parallel vs. series). The brake response time may be controlled based on operational mode using simple components.

The terminology used herein is for the purpose of describing particular embodiments only and is not intended to be limiting. While the description has been presented for purposes of illustration and description, it is not intended to be exhaustive or limited to embodiments in the form disclosed. Many modifications, variations, alterations, substitutions or equivalent arrangement not hereto described will be apparent to those of ordinary skill in the art without departing from the scope of the disclosure. Additionally, while the various embodiments have been described, it is to be understood that aspects may include only some of the described embodiments. Accordingly, the disclosure is not to be seen as limited by the foregoing description, but is only limited by the scope of the appended claims.

What is claimed is:

1. An elevator system comprising:

an elevator car;

a machine to impart motion to the elevator car;

a brake to stop rotation of the machine, the brake comprising a first coil and a second coil, wherein removing power from the first coil and the second coil applies the brake to the machine; and a controller in communication with the brake, the controller configured to connect the first coil and the second coil in one of a first electrical configuration and a second electrical configuration;

wherein the first electrical configuration comprises the first coil and second coil in electrical parallel and the second electrical configuration comprises the first coil and second coil in electrical series;

wherein the controller is configured to stop rotation of the machine by only one of (i) connecting the first coil and second coil in electrical parallel throughout a braking process and (ii) connecting the first coil and second coil in electrical series throughout the braking process.

2. The elevator system of claim 1 further comprising:

a brake management switch connected to the first coil and the second coil, the controller controlling the brake management switch to connect the first coil and the second coil in one of the first electrical configuration and the second electrical configuration.

3. The elevator system of claim 2 wherein:

the brake management switch comprises a relay.

4. The elevator system of claim 1 wherein:

the controller is configured to determine an operating mode of the elevator system, the controller configured to connect the first coil and the second coil in one of the first electrical configuration and the second electrical configuration in response to the operating mode.

5. The elevator system of claim 4 wherein:

the controller is configured to connect the first coil and the second coil in electrical parallel in response to determining that the operating mode of the elevator system comprises a motoring mode.

6. The elevator system of claim 4 wherein:

the controller is configured to connect the first coil and the second coil in electrical series in response to determining that the operating mode of the elevator system comprises a regenerative mode.

7. A method of controlling an elevator brake having a first coil and a second coil, the method comprising:

determining an operating mode of an elevator system; and stopping rotation of a machine by connecting the first coil and the second coil in one of a first electrical configuration and a second electrical configuration in response to the operating mode;

wherein the first electrical configuration comprises the first coil and second coil in electrical parallel and the second electrical configuration comprises the first coil and second coil in electrical series;

wherein stopping rotation of the machine comprises only one of (i) connecting the first coil and second coil in electrical parallel throughout a braking process and (ii) connecting the first coil and second coil in electrical series throughout a braking process.

8. The method of claim 7 wherein:

the connecting comprises connecting the first coil and the second coil in electrical parallel in response to determining that the operating mode of the elevator system comprises a motoring mode.

9. The method of claim 7 wherein:

the connecting comprises connecting the first coil and the second coil in electrical series in response to determining that the operating mode of the elevator system comprises a regenerative mode.

* * * * *